US005423437A

United States Patent [19]

Kayem

[11] Patent Number: 5,423,437

[45] Date of Patent: Jun. 13, 1995

[54] SECURITY DRAINER BASKET FOR KITCHEN UTENSILS

[76] Inventor: Sandy Kayem, 11875 Philippe Hébert, Montréal Qc,H3M 2M9, Canada

[21] Appl. No.: 85,821

[22] Filed: Jul. 6, 1993

[51] Int. Cl.[6] ..... A47F 7/00

[52] U.S. Cl. ..... 211/70.7; 211/181; 248/37.3; D32/55; 220/487

[58] Field of Search ..... 211/41, 181, 70.7; 248/37.3; 220/572, 487, 488; D7/637; D32/55

[56] References Cited

U.S. PATENT DOCUMENTS

| | | | |
|---|---|---|---|
| D. 334,265 | 3/1993 | Giugiaro | D7/637 X |
| 1,484,291 | 2/1924 | Blakeslee | 211/41 |
| 1,810,855 | 6/1931 | Rockmore | 220/487 |
| 2,123,837 | 7/1938 | Thomas et al. | 211/41 X |
| 2,163,865 | 6/1939 | Bitney | D32/55 X |
| 2,712,826 | 7/1955 | Schleyer et al. | 220/488 X |
| 3,742,965 | 7/1973 | Hudziak | D32/55 X |
| 4,610,368 | 9/1986 | Hasebe | 220/488 |
| 4,834,125 | 5/1989 | Insalaco | 211/70.7 X |
| 4,969,560 | 11/1990 | Stanfield | 211/181 X |

*Primary Examiner*—Robert W. Gibson, Jr.
*Attorney, Agent, or Firm*—Antoine H. Gauvin

[57] ABSTRACT

This invention relates in a kitchen drainer having a perforated bottom and a top-free, rectangular, section for kitchen utensils, the improvement which comprises mounted in that section, at least one partition extending above the bottom of the kitchen drainer and in a plane along the width of that section. The partition has an uppermost edge, defining indentations for receiving utensils. The partition may be a wire, a wall and is preferably a security add-on basket. This partition enables an orderly disposal of utensils particularly knives reducing corporal injuries and may even prevent rust of these utensils.

23 Claims, 3 Drawing Sheets

130b
130
130a
130d
130c
112b
120c
116
120
112y
124
112a
112x
112
118c
114
118
122
112c
114b
118b
114a

SECURITY DRAINER BASKET FOR KITCHEN UTENSILS

BACKGROUND OF THE INVENTION

1. Field of the Invention

This invention relates to a security drainer basket for kitchen provided with indentations for receiving utensils, particularly those having a cutting blade such as knives. This invention relates in a particular embodiment to security add-on drainer baskets and partitions for drainer baskets.

2. Description of Related Art

As is well known in the art, kitchen-drainer baskets have been made for about half a century. One of the models is disclosed in U.S. Pat. No. 2,739,715 dated Mar. 27, 1956, as invented by Planeta.

On the other hand a variety of knife stands are known: For instance in U.S. Pat. No. 4,934,539 dated Jun. 19, 1990, Lu teaches a knife stand for placing the knives in a upward position.

In U.S. Pat. No. 4,531,696 dated Jul. 30, 1985, Bettesworth teaches a knife block.

In U.S. Pat. No. 4,324,377 dated Apr. 13, 1982, Jones et al. teach a safety pocket like knife holder.

In U.S. Pat. No. 5,161,691 is disclosed a protecting member to block access to sharp regions.

None of the above patents is teaching Applicant's invention.

The security drainer basket of the present invention aims at:

organizing in an orderly fashion knives and other utensils in drainer baskets, reducing corporal injuries, in particular finger and hand injuries caused by knife blades, rendering dish washing safer, easing in a safer manner the grabbing of knives and other cutting instruments from drainer baskets, preventing rust on utensils, as the utensils such as the blades do not touch each other and dry separately, locking knives in place, blade down with the simplest possible structure.

In a particular embodiment, an add-on is provided which is easy to adapt around a conventional kitchen-drainer basket, thereby providing additional space for drying, easy to store, and can even be used as a safe knife stand when preparing food that requires cutting.

SUMMARY OF THE INVENTION

Broadly stated the invention is directed in a kitchen drainer having a perforated bottom and a top-free, substantially rectangular, section for kitchen utensils, said section having a length and a width, the improvement which comprises mounted in said section, at least one partition extending above said bottom of said kitchen drainer and in a plane along said width of said section, said partition having an uppermost edge, said uppermost edge defining indentations for receiving utensils.

The invention is also directed in a kitchen drainer having a perforated bottom, to an improvement which comprises a top-free, substantially rectangular, security section for kitchen utensils, said section having a length and a width, said section including at least one wall upwardly extending from said perforated bottom of said kitchen drainer and in a plane along said width of said section, said wall defining a lower edge and opposed thereto, an upper edge, said lower edge being adjacent to said perforated bottom, said wall at said upper edge, defining indentations for receiving utensils.

The invention is also directed in a kitchen drainer having a perforated bottom, to the improvement which comprises a top-free, substantially rectangular, security section for kitchen utensils, said section having a length and a width, said section having a length and a width, said section having upwardly extending from said perforated bottom and in a plane along said width of said section, a pair of opposite side walls defining the opposite sides of said section along said width, each of said walls defining a lower edge and opposed thereto, an upper edge, said lower edges being adjacent to said perforated bottom, at least one of said walls at said upper edge, defining indentations for receiving utensils.

By "top-free substantially rectangular section" is meant preferably rectangular though somewhat rectangular are also contemplated so that the utensils be received within said section.

The invention is in a particular embodiment, directed to a security add-on drainer basket for kitchen utensils comprising: a rectangular perforated bottom, said perforated bottom defining opposite longitudinal and opposite lateral edges, and upwardly extending from said perforated bottom, along said opposite longitudinal edges of said perforated bottom, a pair of opposite longitudinal side walls, and upwardly extending from said perforated bottom, along said opposite lateral edges of said perforated bottom, a pair of opposite lateral side walls, each of said side walls defining a lower edge and opposed thereto, an upper edge, said lower edges being adjacent to said edges of said perforated bottom, each of said lateral side walls at said upper edge, defining indentations for receiving utensils, and more preferably when at least one of said longitudinal side walls at said upper edge is provided with means to releasably hook said security add-on drainer basket to a dish-washing drainer basket, for instance a conventional dish-washing drainer basket.

Further embodiments of the invention will be described herein below.

DESCRIPTION OF THE DRAWINGS

In the drawings which illustrate some of the preferred ways of carrying out the invention.

DESCRIPTION OF SOME OF THE PREFERRED WAYS OF CARRYING OUT THE INVENTION

FIG. 1

Figure 1:
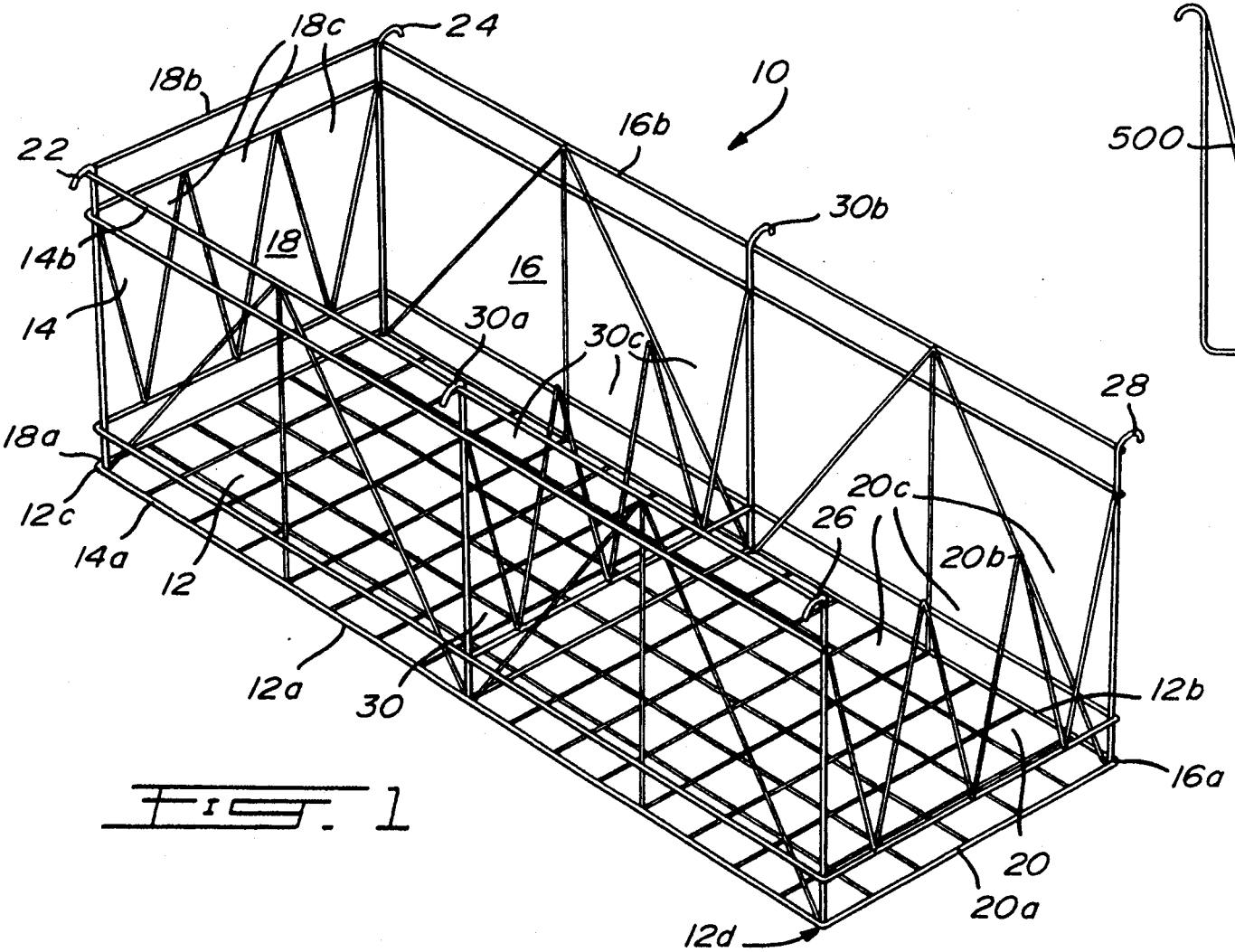
FIG. 1 is a perspective view of a security add-on drainer basket which is wire meshed.

As shown in FIG. 1, a security add-on drainer basket 10 for kitchen utensils comprising: a rectangular perforated bottom 12, to allow water drainage, said perforated bottom defining opposite longitudinal and opposite lateral edges, respectively 12*a*, 12*b*, 12*c*, 12*d*, and upwardly extending from said perforated bottom 12, along said opposite longitudinal edges 12*a*, 12*b*, of said perforated bottom, a pair of opposite longitudinal side walls, 14, 16, and upwardly extending from said perforated bottom 12, along said opposite lateral edges 12*c*, 12*d* of said perforated bottom, a pair of opposite lateral side walls, 18, 20, each of said side walls defining a lower edge respectively 14*a*, 16*a*, 18*a*, and 20*a* and opposed thereto, an upper edge, respectively 14*b*, 16*b*, 18*b*, and 20*b*, said lower edges of said side walls being adjacent to said edges of said perforated bottom, each side wall of said pair of lateral side walls at said upper edge, 18*b*, and 20*b* defining indentations 18*c* 20*c* for receiving cutting blades.

Preferably, at least one of said pair of longitudinal side walls, 14, 16, at their upper edge is provided with means to releasably hook said add-on drainer basket to a dish-washing drainer basket; for instance a conventional dish-washing drainer basket. There are numerous ways to releasably hook said add-on drainer basket to a dish-washing drainer basket, for instance hooks such as 22, 24, 26, 28 having inverted U-shaped or omega-shaped cross-sections.

The indentations may be of various shapes for instance: slits, cuts and V-, U-, E-, M- and W-shaped teeth and preferably V-shaped identical indentations, but irregular indentations being also contemplated.

In a preferred embodiment, the add-on drainer basket, includes at least one, preferably two, intermediate partition such as 30, upwardly extending from the perforated bottom 12, whether perpendicular thereto or tilted, and slidably or fixedly mounted along the longitudinal side walls 14, 16 and displaceable or fixed between the lateral side walls 18,20. Several intermediate partitions of same or variable heights and configurations, may be used if desired, but are not shown for sake of clarity.

Each of the intermediate partitions is defining a lower edge and opposed thereto, an upper edge, said lower edge being adjacent to the edge of the perforated bottom 12, said at least one intermediate partition at said upper edge, defining indentations 30*c*, preferably corresponding to the indentations of the lateral side walls 18, 20 at said upper edge for receiving utensils, though need not be if so desired.

As shown in FIG. 1, each of the side walls 14, 16, 18 and 20 is perpendicular to said perforated bottom. This needs not be and these walls may be tilted as will be shown in FIG. 2 for instance.

In another preferred embodiment the upper edge of said at least one intermediate partition, is in recess with respect to said upper edge of said pair of longitudinal side walls, though it needs not be as shown in FIG. 1.

As shown in FIG. 1, the add-on drainer basket has the perforated bottom and the side walls wire meshed and these wires are preferably coated with a member selected from the group consisting of rubber and resilient polymers, although other rust proof wires may be used, if desired.

In a preferred embodiment, at least one of said opposite longitudinal side walls 14, 16, at said upper edge, has at least two of said wires, such as 24, 28 or 22, 26, or 24, 30*b*, 28 or 22, 30*a*, 26, defining a curved extension outwardly projecting away from said at least one of said opposite longitudinal side walls, said at least two curved extensions providing a means to releasably hook said add-on drainer basket to a dish-washing drainer basket. These curve extensions may define for example, an inverted U-shaped or omega-shaped cross-section.

FIG. 2

Figures 2, 3:
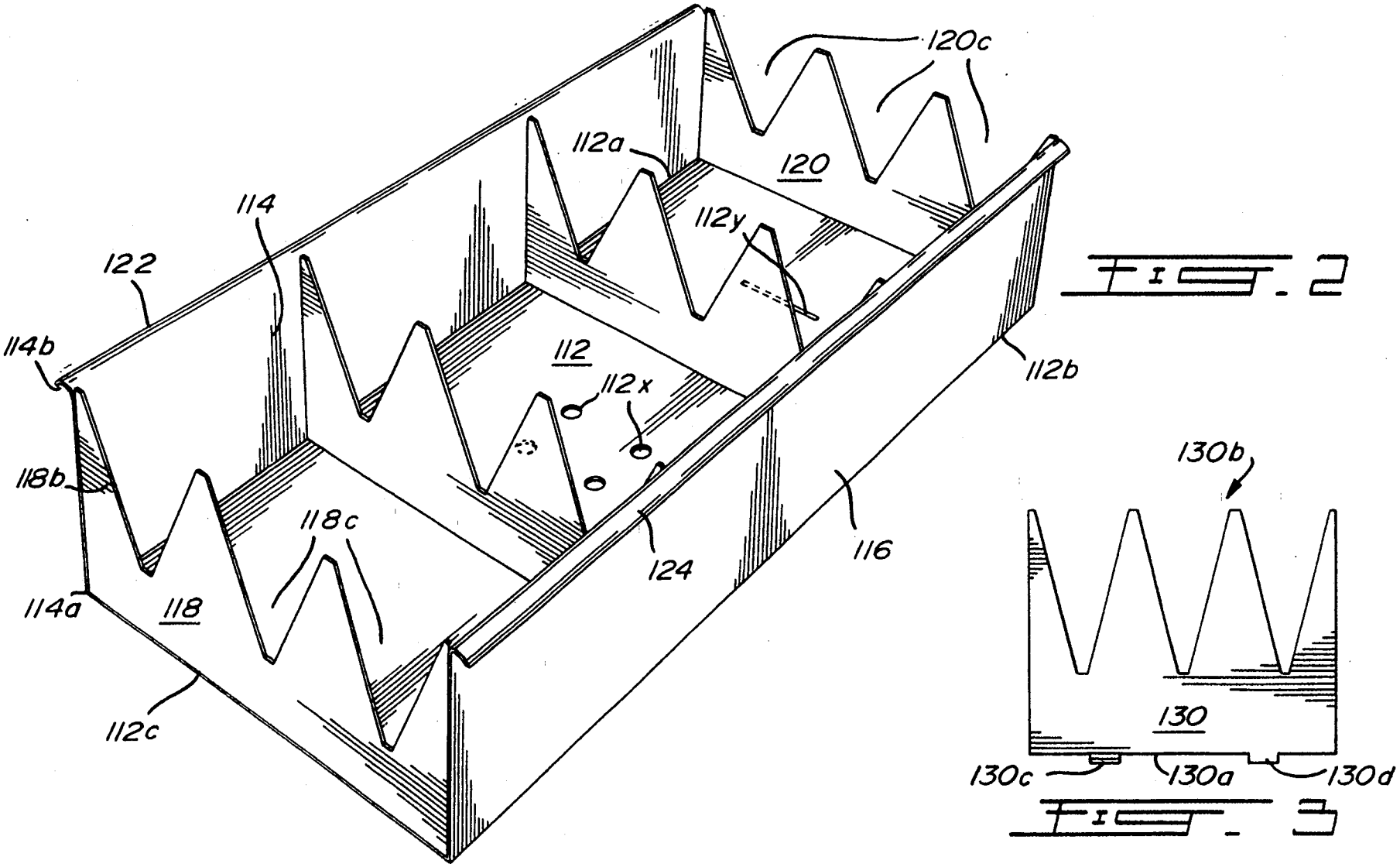
FIG. 2 is a perspective view of a plastic extruded add-on drainer basket.
FIG. 3 is an elevation view of an intermediate partition suitable for the drainer basket shown in FIG. 2.

As shown in FIG. 2, an add-on drainer basket which may be extruded, for instance plastic extruded, has a rectangular perforated bottom 112 as defined by female elements, for instance holes 112*x* or grooves or slots 112*y*. A pair of opposite longitudinal side walls, 114, 116, is upwardly extending from said perforated bottom 112, along the opposite longitudinal edges such as 112*a*, of said perforated bottom, and upwardly extending from said perforated bottom 112, along said opposite lateral edges such as 112*c*, of said perforated bottom, a pair of opposite lateral side walls, 118, 120, each of said side walls defining a lower edge, such as 114*a*, and opposed thereto, an upper edge, such as 114*b*, said lower edges being adjacent to said edges of said perforated bottom, each side wall of said pair of lateral side walls at said upper edge, defining indentations 118*c* 120*c* for receiving cutting blades.

Preferably, at least one of said longitudinal side walls, 114, 116, at their upper edge is provided with means to releasably hook said add-on drainer basket to a dish-washing drainer basket. There are numerous ways to releasably hook said add-on drainer basket to a dish-washing drainer basket, for instance a hook such as 122, 124 wherein at least one of said opposite longitudinal side walls, at said upper edge, defines a curved extension outwardly projecting away from said at least one of said opposite longitudinal side walls, and substantially parallel to said perforated bottom, said curved extension providing said means to releasably hook said add-on drainer basket to a dish-washing drainer basket or by providing extensions having an omega-shaped cross-section.

Each of the longitudinal side walls is tilted and correspondingly each lateral side wall is perpendicular to said perforated bottom, and tapering toward said perforated bottom.

As shown in FIG. 2, the upper edge of the at least one intermediate partition, may be in recess with respect to said upper edge of the pair of longitudinal side walls.

FIG. 3

Aside from the intermediate partition 30 of FIG. 1, as shown in FIG. 3, at least one intermediate partition, such as at 130, may be built to be removably mounted on a perforated bottom, for instance 112 of FIG. 2, to upwardly extend from and preferably perpendicularly to said perforated bottom, via the female elements, for instance holes 112*x*, or grooves, mortises or slots 112*y* or other connecting devices. Each of the intermediate partitions defines a lower edge such as 130*a*, and opposed thereto, an upper edge such as 130*b*, said lower edge being provided with corresponding male elements such as pins, pegs, tongues, schematically shown as 130*c*, 130*d*, for male-female engagement or other connecting engagements.or adjacent to said edge of said perforated bottom, said at least one intermediate partition at said upper edge, defining indentations corresponding to said indentations of said at least one of said pair of longitudinal side walls at said upper edge for receiving utensils.

If desired the walls, for instance the longitudinal side walls, 114 116 and the intermediate partitions may be provided with male-female engagement or other connecting engagements to removably mount these intermediate partitions.

FIG. 4

Figure 4:
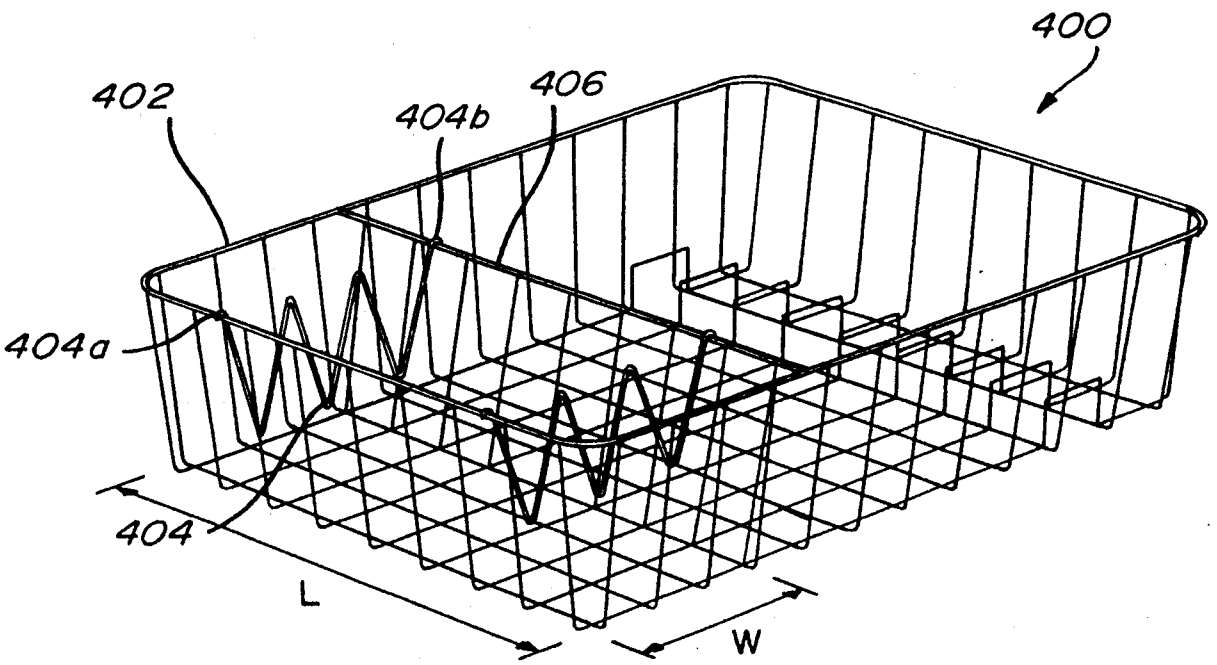
FIG. 4 is an elevation view of an intermediate partition suitable for providing security to a kitchen drainer having a built-in-section for utensils.

These walls which may also be considered partitions, may be replaced with merely a strip or a wire bridging opposed sidewalls of a drainer basket as shown in FIG. 4, thereby providing in a kitchen drainer 400 having a perforated bottom and a top-free, substantially rectangular, section 402 for kitchen utensils, said bottom being as shown, a receptacle for receiving kitchen ware as is well known, said section for kitchen utensils having a length L and a width, W the improvement which comprises mounted in said section, at least one partition 404 extending above said per bottom of said kitchen drainer and in a plane along said width of said section, said partition having an uppermost edge, said uppermost edge defining indentations for receiving utensils and particularly as shown in FIG. 4, in a kitchen drainer as defined above, wherein said section has longitudinal sides defining said width, and said sides are wire meshed, said partition is a wire, and said indentations are defined by said wire running in zigzag, said wire defining opposite ends, such as 404*a*. 404*b*, said ends being U- or omega-shaped to snugly engage wires of said wire mesh longitudinal sides.

Figure 5:
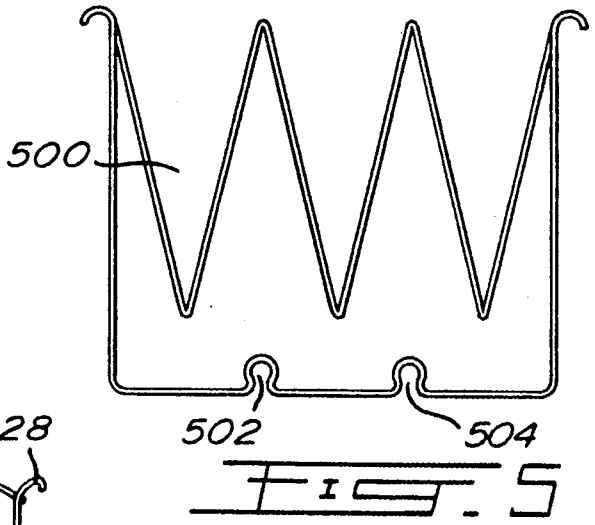
FIG. 5, next to FIG. 1, is an elevation view of another intermediate partition suitable for drainer baskets such as shown in FIGS. 2 and 4.

Instead as shown in FIG. 5, the perforated bottom defines plurality of male-female arrangements and said partition defines a base having a plurality of male-female arrangements in relation to said male-female arrangements of said perforated bottom within said section to releasably hold said partition within said section. For instance as one example only, the perforated bottom may be defined by wires, said wires being wire meshed, and said section raising from said wire meshed bottom, and said partition defines a base having a plurality of omega-shaped apertures such as 502, 504 in relation to said wires of said wire meshed bottom within said section.

EXAMPLE

An add-on drainer basket was made as shown in FIG. 1 and being 2"×2"×10". Others add-on drainer baskets as shown in FIGS. 2 and 3 were also made, one being 3.5" wide, 4" deep and 9–11" long. The partitions of FIGS. 4 and 5 were also made for conventional kitchen drainer baskets.

While some of the preferred embodiments have been described herein above, it is to be understood that the invention is not to be construed as limited to these preferred embodiments, as many modifications and variations are possible within the spirit and scope of the appended claims.

I claim:

1. In a kitchen drainer having a perforated bottom and a top-free, substantially rectangular, section for kitchen utensils, said perforated bottom being a receptacle for receiving kitchen ware, said section for kitchen utensils having a length and a width, the improvement which comprises mounted in said section, at least one partition extending above said perforated bottom of said kitchen drainer and in a plane along said width of said section, said partition having an uppermost edge, said uppermost edge defining indentations for receiving utensils.

2. The kitchen drainer as defined in claim 1, wherein said section has longitudinal sides defining said width, and said sides are wire meshed, said partition is a wire above said perforated bottom, and said indentations are defined by said wire running in zigzag, said wire defining opposite ends, said ends being U-shaped to snugly engage wires of said wire mesh longitudinal sides.

3. In a kitchen drainer having a perforated bottom, the improvement which comprises a top-free, substantially rectangular, security section for kitchen utensils, said section having a length and a width, said section including at least one wall upwardly extending from said perforated bottom of said kitchen drainer and in a plane along said width of said section, said wall defining a lower edge and opposed thereto, an upper edge, said lower edge of said wall being adjacent to said perforated bottom, said wall at said upper edge, defining indentations for receiving utensils.

4. In a kitchen drainer having a perforated bottom as defined in claim 3, wherein said at least one wall is a pair of opposite side walls upwardly extending from said perforated bottom and in a plane along said width of said section, defining the opposite sides of said section along said width, each of said walls defining a lower edge and opposed thereto, an upper edge, said lower edges of said walls being adjacent to said perforated bottom, at least one of said walls at said upper edge, defining indentations for receiving utensils.

5. The kitchen drainer as defined in claim 4, wherein said indentations are members selected from the group consisting of slits, cuts and V-, U-, E-, M- and W-shaped teeth.

6. The kitchen drainer as defined in claim 4, wherein each of said opposite walls at said upper edge, has V-shaped indentations, and the indentations defined in one of said opposite walls are identical to the indentations defined in the other of said opposite walls.

7. A security add-on drainer basket for kitchen utensils comprising:

a rectangular perforated bottom, said perforated bottom defining opposite longitudinal and opposite lateral edges, and upwardly extending from said perforated bottom, along said opposite longitudinal edges of said perforated bottom, a pair of opposite longitudinal side walls, and upwardly extending from said perforated bottom, along said opposite lateral edges of said perforated bottom, a pair of opposite lateral side walls, each of said side walls defining a lower edge and opposed thereto, an upper edge, said lower edges of said walls being adjacent to said edges of said perforated bottom, each of said lateral side walls at said upper edge, defining indentations for receiving utensils.

8. The add-on drainer basket for kitchen utensils as defined in claim 7, wherein at least one of said pair of longitudinal side walls at their upper edge is provided with means to releasably hook said add-on drainer basket to a dish-washing drainer basket.

9. The add-on drainer basket as defined in claim 7, wherein each of said lateral sides at said upper edge, has V-shaped indentations, and the indentations defined in one of said lateral sides are identical to the indentations defined in the other of said lateral sides.

10. The add-on drainer basket as defined in claim 7, which includes at least one removably and upwardly mounted intermediate partition, said at least one intermediate partition defining a lower edge and opposed thereto, an upper edge, said lower edge being adjacent to said edge of said perforated bottom, said at least one intermediate partition at said upper edge, defining indentations corresponding to said indentations of said at least one of said pair of longitudinal side walls at said upper edge for receiving utensils.

11. The add-on drainer basket as defined in claim 10, wherein said upper edge of said at least one intermediate partition, is in recess with respect to said upper edge of said pair of longitudinal side walls.

12. The add-on drainer basket as defined in claim 7, which includes at least one removably mounted intermediate partition perpendicular to said perforated bottom and removably mounted on one of the members selected from said perforated bottom and said longitudinal side walls, each of said at least one intermediate partition defining a lower edge and opposed thereto, an upper edge, said at least one intermediate partition at said lower edge, being adjacent to said edge of said perforated bottom, said at least one intermediate partition at said upper edge, defining indentations corresponding to said indentations of said at least one of said pair of longitudinal side walls at said upper edge for receiving utensils.

13. The add-on drainer basket as defined in claim 12, wherein said upper edge of said at least one intermediate partition, is in recess with respect to said upper edge of said pair of longitudinal side walls.

14. The add-on drainer basket as defined in claim 7, wherein at least one of said pair of opposite longitudinal side walls, at said upper edge, defines a curved extension outwardly projecting away from said at least one of said pair of opposite longitudinal side walls, and substantially parallel to said perforated bottom, said curved extension providing means to releasably hook said add-on drainer basket to a dish-washing drainer basket.

15. The add-on drainer basket as defined in claim 7, wherein said perforated bottom and said side walls are wire meshed and said wires are coated with a member selected from the group consisting of rubber and resilient polymers, at least one of said pair of opposite longitudinal side walls, at said upper edge, having at least two of said wires defining a curved extension outwardly projecting away from said at least one of said pair of opposite longitudinal side walls, said at least two curved extensions providing means to releasably hook said add-on drainer basket to a dish-washing drainer basket.

16. The add-on drainer basket as defined in claim 7 wherein said perforated bottom and said side walls are plastic extruded.

17. The add-on drainer basket as defined in claim 7, wherein said indentations are members selected from the group consisting of slits, cuts and V-, U-, E-, M- and W-shaped teeth.

18. The add-on drainer basket as defined in claim 7, wherein each of said side walls is perpendicular to said perforated bottom.

19. The add-on drainer basket as defined in claim 7, wherein each of said longitudinal side walls is tilted and correspondingly each lateral side wall is perpendicular to said perforated bottom, and tapering toward said perforated bottom.

20. The add-on drainer basket as defined in claim 10, wherein said intermediate partition is mounted perpendicular to said perforated bottom.

21. A partition for a kitchen drainer having a perforated bottom and a top-free, substantially rectangular, section for kitchen utensils, said section having a length and a width, said section having opposite longitudinal sides, each of said longitudinal sides, including at least one wire, said partition being a wire, said wire having a first end and an opposite end, between said ends, said wire being in zigzag as to define indentations for receiving utensils, said ends being U-shaped to snugly engage said wires of said wire of said longitudinal sides and thereby to produce a security add-on drainer basket for kitchen utensils.

22. The partition as defined in claim 1, wherein, said perforated bottom defines plurality of male-female arrangements and said partition defines a base having a plurality of male-female arrangements in relation to said male-female arrangements of said perforated bottom within said section to releasably hold said partition within said section.

23. The partition as defined in claim 1, wherein, said perforated bottom is defined by wires, said wires being wire meshed, and said section raising from said wire meshed bottom, and said partition defines a base having a plurality of omega-shaped apertures in relation to said wires of said wire meshed bottom within said section.

* * * * *